US007986245B1

(12) United States Patent
Seutter et al.

(10) Patent No.: US 7,986,245 B1
(45) Date of Patent: Jul. 26, 2011

(54) MEASUREMENT WHILE DRILLING MUD PULSER CONTROL VALVE MECHANISM

(75) Inventors: Daniel C. Seutter, Beaumont (CA); Robert Diederichs, Sherwood Park (CA); Andy MacCallum, Cochzane (CA); Jerry Yee, Edmonton (CA)

(73) Assignee: Steertek Ltd., Edmonton, AB (CA)

( * ) Notice: Subject to any disclaimer, the term of this patent is extended or adjusted under 35 U.S.C. 154(b) by 1007 days.

(21) Appl. No.: 11/591,103

(22) Filed: Nov. 1, 2006

(51) Int. Cl.
*E21B 34/00* (2006.01)

(52) U.S. Cl. ..... 340/854.3; 367/85; 340/855.4

(58) Field of Classification Search ..... 367/85; 340/854.3
See application file for complete search history.

(56) References Cited

U.S. PATENT DOCUMENTS 6,002,643 A * 12/1999 Tchakarov et al. ..... 367/85
6,016,288 A * 1/2000 Frith ..... 367/85
6,636,159 B1 * 10/2003 Winnacker ..... 340/854.3

* cited by examiner

*Primary Examiner* — Albert K Wong
*Assistant Examiner* — Hung Q Dang
(74) *Attorney, Agent, or Firm* — Bracewell & Giuliani LLP

(57) ABSTRACT

A mud pulser creates pressure pulses in a stream of drilling fluid circulating through a drill string. The pulser has a body connected into the drill string, and defines a flow passage for drilling fluid. A signal poppet having a piston is reciprocally carried within the body. A lower end of the poppet selectively restricts flow of drilling fluid through an orifice and to thereby increase pressure and creates a pulse while in an extended position. An inner passage with an upward facing servo seat formed therein is located in the body and extends through the signal poppet for the passage of drilling fluid. A motor-driven servo valve selectively engages the servo seat to control flow of drilling fluid through the inner passage. A limit switch responds to axial movement of the servo valve cause the motor to turn off when the servo valve reaches predetermined axial positions.

12 Claims, 5 Drawing Sheets

MEASUREMENT WHILE DRILLING MUD PULSER CONTROL VALVE MECHANISM

BACKGROUND OF THE INVENTION

1. Field of the Invention

This invention relates in general to downhole tools and in particular to a pulser for measurement while drilling tools.

2. Background of the Invention

Measurements of drill string orientation must be made while drilling a well bore in order to successfully reach targeted production zones within the formation of the earth. These measurements must be transmitted to the surface in a timely manner even at vertical depths of over three thousand meters. Measurement while drilling (MWD) allows for the surface acquisition of downhole data during drilling, thereby reducing the need for costly and time consuming drill string tripping and logging/survey runs otherwise necessary to acquire downhole data. The MWD device is set behind the bit at the surface and remains there as the drill string bores downward and so must be self powered. It is therefore, important that the mechanism for communicating its orientation measurements or surveys to the surface must be power efficient.

In modern MWD systems, one common mechanism for communicating to the surface with is downhole pulsers. Pulsers generate pressure surges or pressure pulses in drilling fluid or mud which is flowing through a drill string. The MWD information is coded in a sequence of pulses so that it can be sensed or "read" at the surface. In one type of pulser, pulses are created by partially obstructing an orifice in the drill string through which the drilling mud is flowing with a signal poppet. The signal poppet is moved rapidly in and out of the orifice to create a pressure spike that can be detected at the surface. Some pulsers require many moving parts and require significant amounts of power which quickly deplete the energy reserves of battery-powered tools. An improved pulser is desirable.

Typical downhole measurement tools communicate to the surface by creating positive pressure pulses in the drilling fluid that is pumped downhole from the surface. These pressure pulses are achieved within a portion of the measurement tool called a mud pulser. The pulser has a piston which is driven into a nozzled flow restriction mounted within the drill string in order to create the pressure pulse. The power to drive the piston with great force into this restriction is provided by the hydraulic energy of the drilling fluid. The high velocity drilling fluid travels past a cavity or inner passage within the pulser, creating a vacuum which is used to hold the piston up and out of the orifice. This vacuum effect is referred to as the Bernoulli Effect. When a valve, positioned at the top of the vacuum cavity is opened, an equalization of the pressure within the cavity and the pressure outside the pulser drives the piston down into the orifice and creates the pressure pulse. When the valve is closed, a vacuum is again created and the piston is pulled out of the orifice. This valve is manipulated using autonomous power of the MWD device.

Mud pulsers of the style described above are used by several corporations. The variation between these similar devices mainly occurs in the size of poppet, sizes of the restriction nozzle within the pulser sub or orifice, the length of the pulser and the mechanism for manipulating the control valve. The mechanism largely dictates the electrical power required to create the pressure impulse and the other variations largely effect the size and shape of the pressure impulse.

The linear movement of the control valve has been accomplished in several ways. One prior assembly included a single solenoid which pulled the control valve open. In order to retain the valve in the open position, the solenoid had to remain energized. Returning of this valve to the closed position was accomplished with a return spring. This spring was directly opposing the solenoid and hence low levels of pull force were achieved and extra electrical power was expended to keep the valve open. Low levels of pull force cause operating limitations of the pulser as a communication device. A second design utilized two solenoids positioned back-to-back such that when activated, one pulled the valve open and the second pulled the valve closed when neither solenoid was energized. The compression force required to open or hold open the valve is lower than the force required to close the valve (which was provided by the closed solenoid) and so some pull force was gained and the electrical energy required to keep the valve open was reduced. With the solenoid designs, a large capacitive bank, continually charged, was required to store up the large amounts of electrical current expensed while energizing the solenoids. This capacitive bank would add greater than 3 decimeters to the length of the pulser.

A newer method of valve manipulating utilizes a direct current motor or direct current stepper motor to rotate a shaft connected to a mechanical device (such as a screw, worm screw or ball screw) which translates rotational movement into axial movement. With this method, greater force could be achieved in both the opening and closing of the valve while only using one manipulating device. In addition, no electrical current or spring is needed to hold the valve on either position. To prevent the motor from attempting to open or close the valve passed its safe operating extends a stop or position detection mechanism must be incorporated. The existing pulsers of this type employ a current monitoring technique. The electrical current drawn by the motor is electronically measured. The measurements are filtered either by digital or analog means and then the resulting signal is passed through an algorithm which detects when the motor has stalled or has begun to drive the valve passed its operating extents. Both of these conditions will create a great increase in the electrical current demanded by the motor. This position detection method has several undesirable limitations mainly due to the fact that valve interference is required for the detection. The motor shaft cannot be stopped instantaneously because of its angular momentum. If the shaft is turned at a high velocity in order to achieve the required rapid valve transition (such as in the solenoid designs) its momentum will carry it harder into the extents of valve travel even after the motor is no longer energized. The higher levels of motor current used to detect the position of the valve cause excess energy expense. Also, much greater electrical current is required to start the motor in the opposite direction because of the additional friction caused by the excess travel into the valves operating extents due to its momentum. This friction can be significant and will often result in the valve being "stuck" as the electrical power available diminishes. These continual collisions of the valve with its open and closed extents also cause significant mechanic wear.

When the amount of pulling force available for opening the valve is low, the hydraulic conditions needed to drive the piston into the pulser sub may hold the valve in the closed position and prevent the creation of a pressure pulse. To aid pulsers with low valve pull, varieties of piston sizes and pulser sub mariations have been created to maintain the manageable required valve pull force within a specific range of drill fluid flow rates. In order to operate over a broad range of flow rates, many combinations of pistons and pulser subs must be available. Some of these combinations may allow for valve movement but have negative or diminishing effects on the pressure pulse. A greater valve pull force allows for larger flow rate operating ranges without the necessity of carefully selecting the piston size and pulser sub restriction.

SUMMARY OF THE INVENTION

A downhole measurement tool containing measurement instruments and a mud pulser is located within a string of drill pipe. The mud pulser creates pressure pulses in a stream of drilling fluid circulating through a drill string. The pulser has a pulser body that is connected into the drill string. Typically, the pulser body lands on a shoulder in the drill string. The pulser body defines a main flow passage for the passage of drilling fluid. An axial orifice is formed adjacent a lower end of the pulser body, through which drilling fluid flows to the drill bit. A signal poppet with an annular piston is reciprocally carried within the body. The piston and poppet slidingly reciprocates within the axial bore in the body. The signal poppet has a lower end that selectively restricts flow through the orifice and increases the drilling fluid pressure to thereby create a pressure pulse while in an extended position. The lower end allows flow unrestricted flow while in a retracted position removed from the orifice. An inner passage is located in the pulser body and extends through the piston and the signal poppet for the passage of drilling fluid from the main flow passage. The inner passage has an upward facing servo seat formed therein. The pulser also has an axially movable servo valve that selectively engages the servo seat to control flow of drilling fluid through the inner passage. A motor carried within the pulser body drives the servo valve into and out of engagement with the servo seat. A limit switch that is in electrical communication with the motor is responsive to axial movement of the servo valve to cause the motor to turn off when the servo valve reaches predetermined positions when extending and retracting into and out of engagement with the valve seat.

In the downhole mud pulser, the servo valve can also have a valve mandrel positioned toward an upper axial portion of the servo valve. The valve mandrel can be movable with the lower portion of the servo valve while the servo valve engages and disengages the valve seat. The valve mandrel can register with the limit switch as the servo valve extends and retracts into and out of engagement with the valve seat.

In the downhole mud pulser, the signal poppet can be downwardly biased. The mud pulser can also have a port formed in the pulser body that opens from the main flow passage to a point below and in communication with the piston to supply pressure from the drilling fluid.

The mud pulser can also have a motor converter that translates rotational movement of a drive shaft of the motor to axial movement of the servo valve. The motor converter can be a mechanical device selected from a group consisting of a screw, lead screw, a worm screw, a worm gear, a worm screw, and a ball screw.

In another aspect of the invention, a downhole assembly has a drill string extending into a well, in which the drill sting includes a downhole mud pulser for creating pressure pulses in a stream of drilling fluid circulating through the drill string. The mud pulser has a pulser body that defines a main flow passage for the passage of the drilling fluid, and an orifice positioned axially below the pulser body to receive the drilling fluid from the main flow passage. A downwardly biased signal poppet has an annular piston reciprocally carried within the body. The signal poppet has a lower end that selectively restricts flow through the orifice. The lower end of the signal poppet restricts flow of the drilling fluid and creates a pressure pulse while in an extended position within the orifice, and allows the flow of the drilling fluid to increase while in a retracted position removed from the orifice. The piston and signal poppet have an inner passage extending axially therethrough to communicate drilling fluid from the main flow passage. The inner passage has an upward facing servo seat formed therein. A port in the body leads from the main flow passage to a point below and in communication with the piston to supply pressure from the drilling fluid. An axially movable servo valve selectively engages the servo seat to control flow of drilling fluid through the inner passage. The servo valve has a valve mandrel positioned toward an upper portion of the servo valve. A motor is carried within the pulser body and in engagement with the valve mandrel to drive the servo valve into and out of engagement with the servo seat. A limit switch is in electrical communication with the motor. The limit switch is responsive to axial movement of the valve mandrel to cause the motor to turn off when the servo valve reaches predetermined positions when extending and retracting into and out of engagement with the valve seat.

In the downhole mud pulser, the valve mandrel can include an upward facing shoulder and a downward facing shoulder. Engagement of the limit switch and the upward facing shoulder causes the motor to turn off and ceases upward movement of the servo valve. Engagement of the limit switch and the downward facing shoulder causes the motor to turn off and ceases downward movement of the servo valve. The limit switch comprises first and second limit switch actuators. The first limit switch actuator causes the motor to turn off when the servo valve reaches the predetermined position when extending into engagement with the valve seat. The second limit switch actuator causes the motor to turn off when the servo valve reaches the predetermined position when retracting out of engagement with the valve seat. The downhole mud pulser can also have a motor converter that translates rotational movement of a drive shaft of the motor to axial movement of the servo valve. The motor converter comprising a mechanical device selected from a group consisting of a screw, lead screw, a worm screw, a worm gear, a worm screw, and a ball screw.

In the downhole mud pulser, the valve mandrel can include an upward facing shoulder and a downward facing shoulder. The first limit switch actuator causes the motor to turn off when the downward facing shoulder engages the first limit switch. The second limit switch actuator causes the motor to turn off when the upward facing shoulder engages the second limit switch. The servo valve engages the valve seat when the downward facing shoulder engages the first limit switch. The servo valve is out of engagement with the valve seat when the upward facing shoulder engages the second limit switch.

Another aspect of the invention includes a method for creating a pressure pulses in a stream of drilling fluid circulating through a drill string. The method includes the step of (a) providing a downhole mud pulser having a pulser body connected into the drill string and a signal poppet having an annular piston reciprocally carried within the pulser body, the pulser body defining a main flow passage for the passage of drilling fluid. The method also includes the step of (b) mounting an orifice in the drill string and communicating drilling fluid through the orifice from the main flow passage. The method further includes the step of (c) selectively restricting flow through the orifice with a lower end of the signal poppet and thereby creating a pressure pulse. Finally, the method includes the step of (d) selectively increasing the flow of the drilling fluid through the orifice by retracting the lower end of the signal poppet from the orifice. Steps (c) and (d) are performed by selectively operating a motor and driving a servo valve into and out of engagement with an upward facing valve seat associated with an inner passage formed in the pulser body that extends through the piston and the signal poppet for the passage of drilling fluid from the main flow passage. In steps (c) and (d), the motor is caused to be turned on and off by actuating a limit switch that is responsive to axial movement of the servo valve as the servo valve reaches predetermined positions when extending and retracting into and out of engagement with the valve seat.

In the method for creating a pressure pulses in a stream of drilling fluid circulating through a drill string, steps (c) and (d) further comprise registering the limit switch with a valve mandrel as the servo valve extends and retracts into and out of engagement with the valve seat in order to actuate the limit switch.

DETAILED DESCRIPTION OF THE PREFERRED EMBODIMENT

Figure 1:
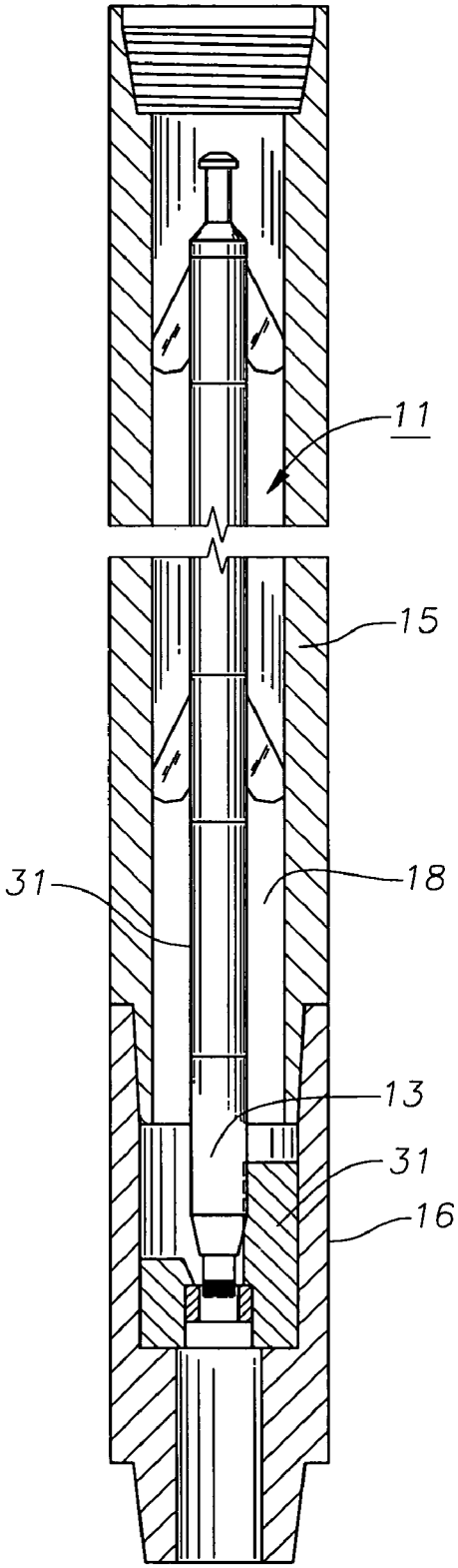
FIG. 1 is a schematic view of a well with a curved portion and a downhole MWD tool that is constructed in accordance with the invention.

Referring to FIG. 1, a downhole measurement tool 11 for use in a well is shown. In the preferred embodiment, tool 11 is battery powered. Tool 11 is typically lowered into a well through the inner diameter of a string of drill pipe 15 and a muleshoe sub 16 on a wireline (not shown). The wireline is then retrieved. Drilling fluid is supplied to the drill bit (not shown) that located below the tool 11. The drilling fluid is supplied though an annulus 18 formed between tool 11 and drill pipe 15. In the preferred embodiment, tool 11 comprises two or more measurement instruments in a measurement module (not shown). One of the instruments makes a gamma ray measurement of the formation being drilled. Another of the instruments measures inclination and azimuth. The measurements are digitized and a driver circuit or driver module (not shown) supplies two digital signals, on and off, to a mud pulser 13. The instruments in the measurement module are conventional.

Figure 2A:
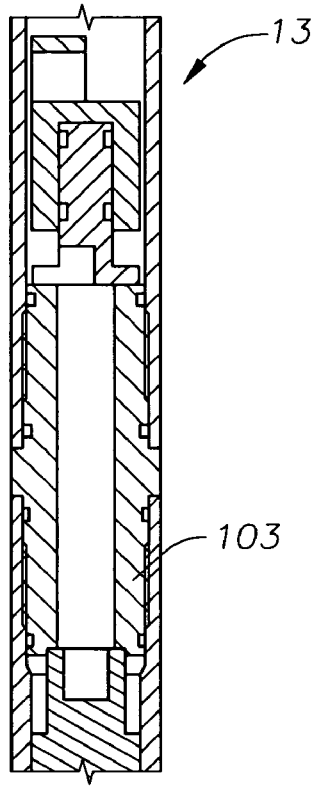
FIGS. 2A through 2E comprise a sectional view of the pulser portion of the tool of FIG. 1.
Figure 2B:
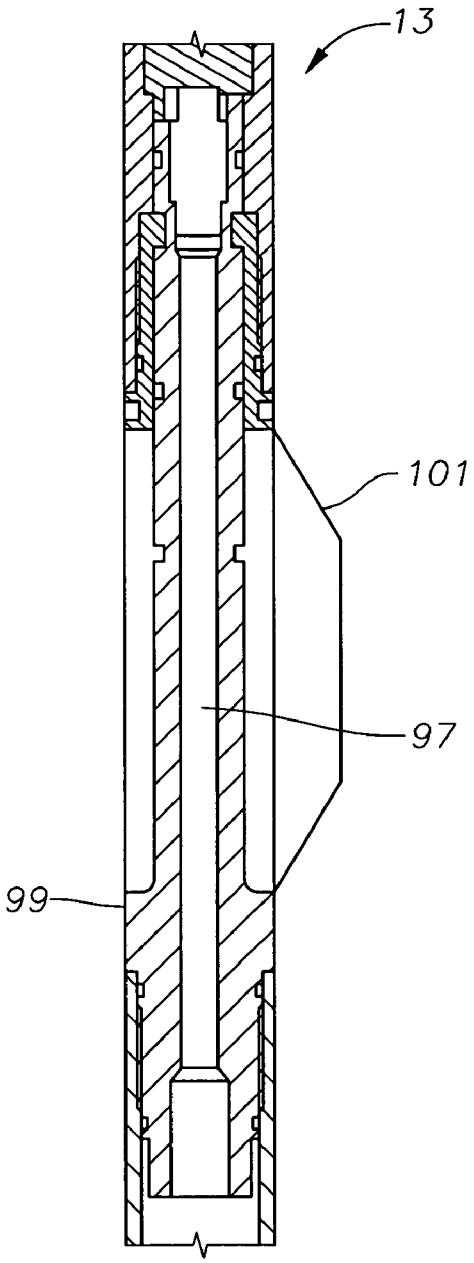
Figure 2C:
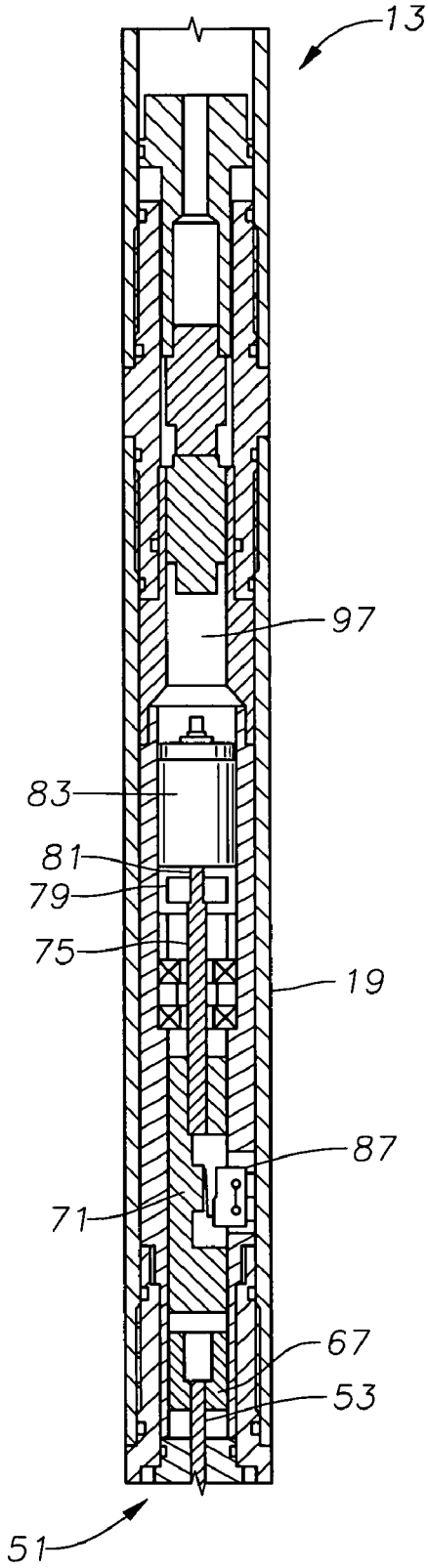
Figure 2D:
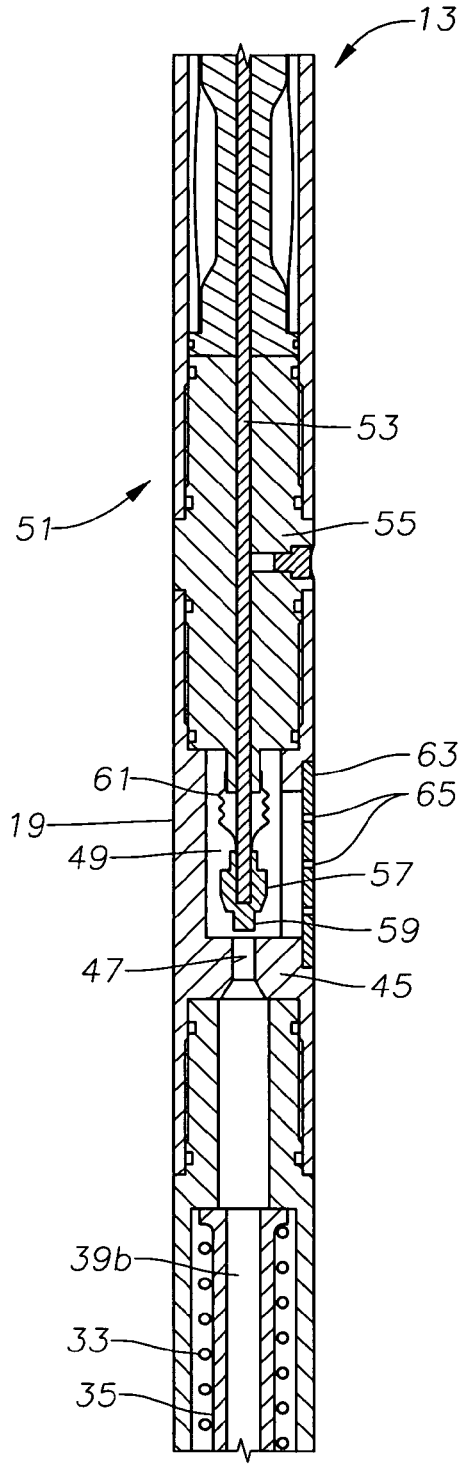
Figure 2E:
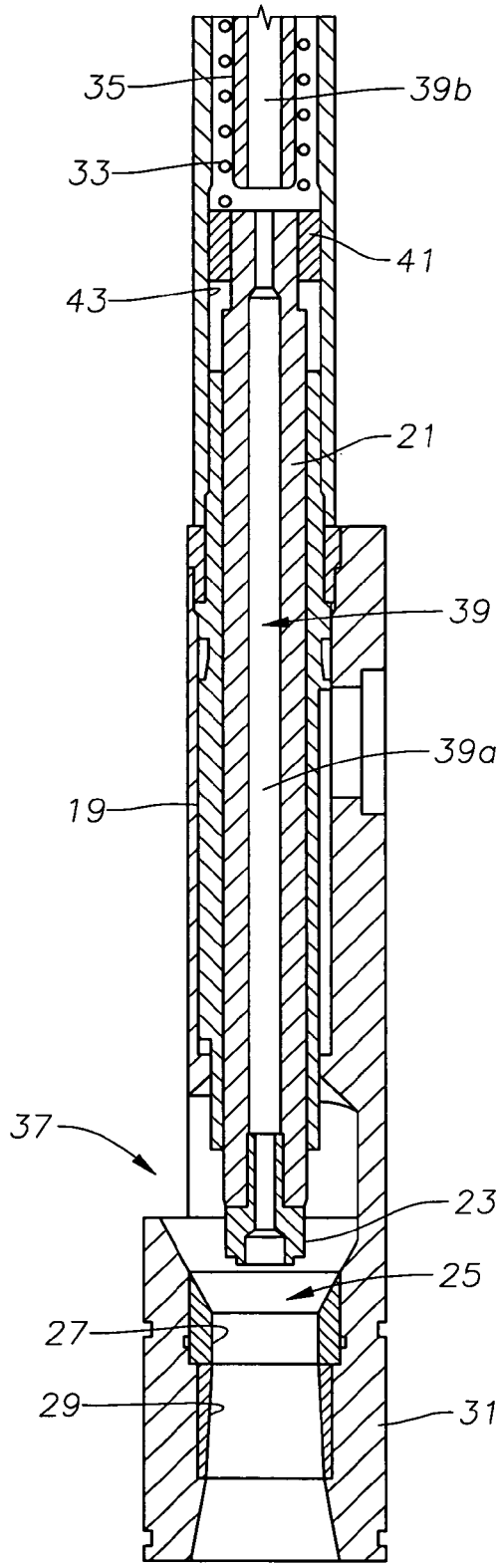
Figure 3A:
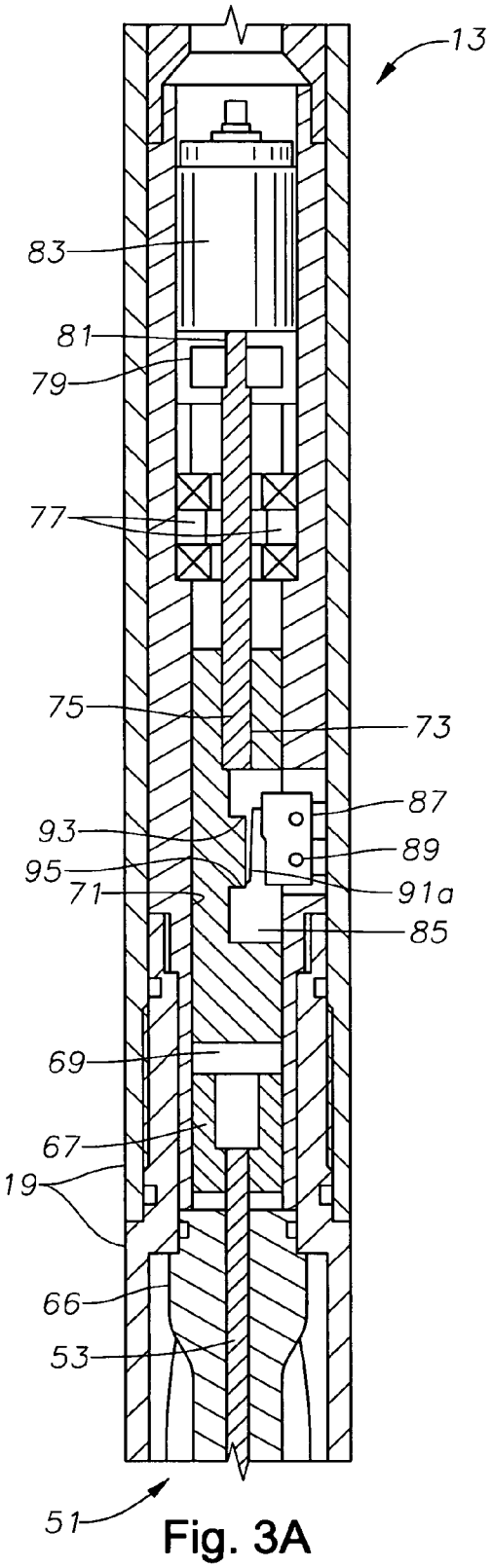
FIGS. 3A and 3B comprise a partial sectional view of the pulser of FIGS. 2A-2E in a closed position.
Figure 3B:
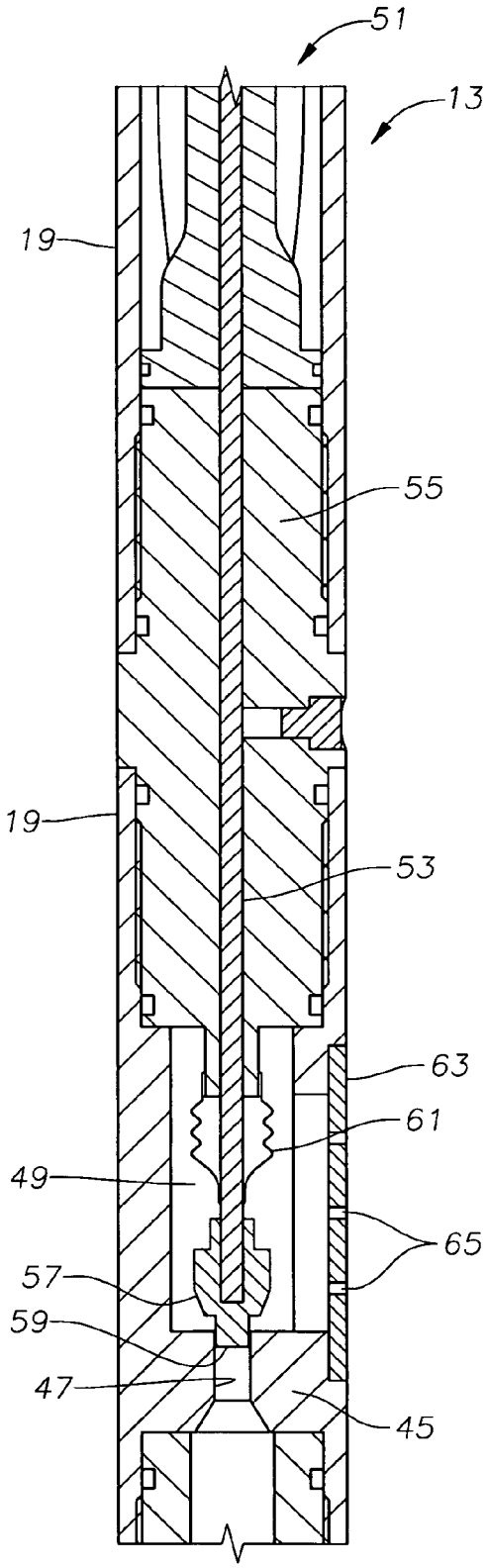
Figure 4A:
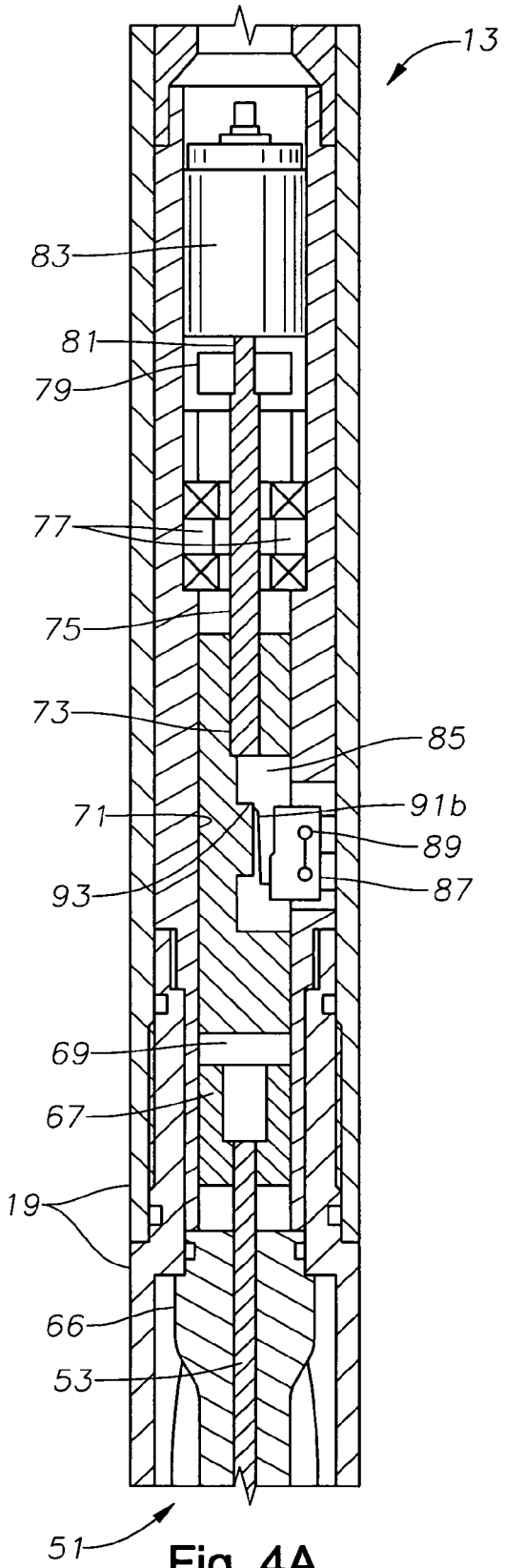
FIGS. 4A and 4B comprise a partial sectional view of the pulser of FIGS. 2A-2E in an open position.
Figure 4B:
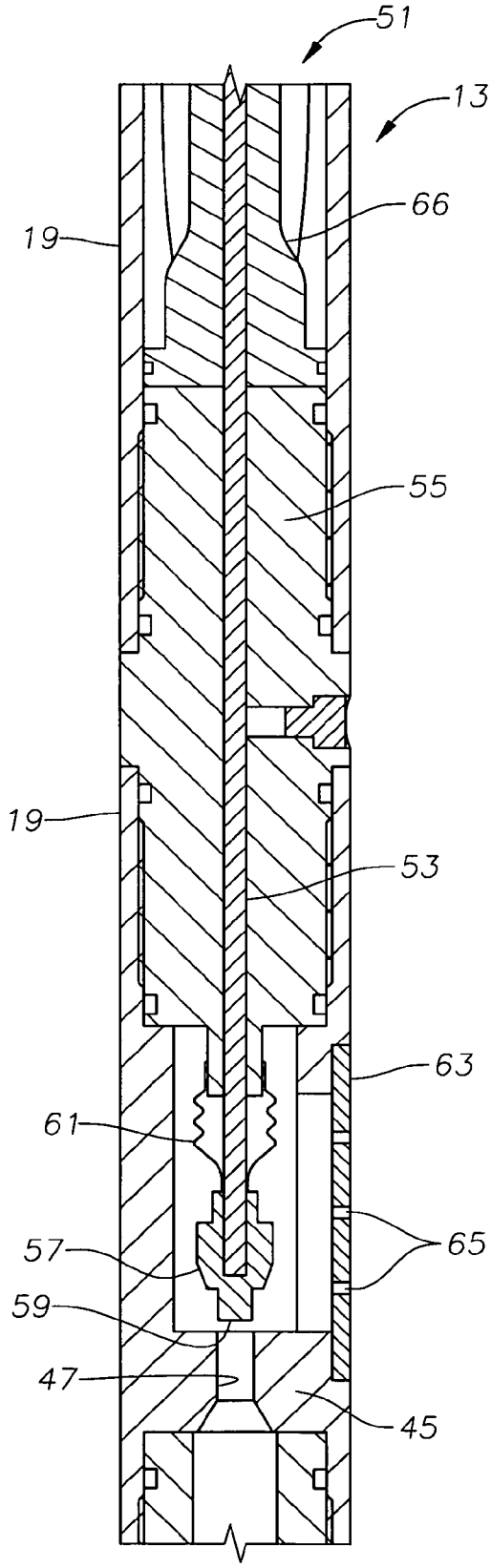

Referring also to FIGS. 1-2E, pulser 13 creates pressure pulses in the stream of drilling fluid being circulated in annulus 18 in response to the digital signals provided by the driver circuit of the measurement module. Pulser 13 has a generally cylindrical, hollow pulser body 19 with a number of body segments rigidly secured to one another. In the preferred embodiment, the lowermost segment of body 19, lands on an upward facing shoulder of an orientation sleeve 31 of either drill pipe 15 or muleshoe sub 16. A signal poppet 21 is generally carried within a lower segment of pulser body 19. Signal poppet 21 has a lower end portion or poppet tip 23 toward its axially lowermost end. Signal poppet 21 is preferably axially movable within pulser body 19 between an extended position (FIG. 1) and a retracted position (FIG. 2E).

An orifice 25 is positioned to allow axial flow of the drill fluid from annulus 18. In the preferred embodiment, orifice 25 is positioned axially below lower end 23 of signal poppet 21. Orifice 25 preferably comprises an upper orifice sleeve 27 and a lower orifice sleeve 29. The upper orifice sleeve preferably has an inclined surface toward its upper end such that the inner diameter of the uppermost portion of orifice 25 is greater than an inner diameter of orifice 25 at the lower end of the inclined surface. Upper and lower orifice sleeves 27, 29 are preferably carried within an orienting sleeve 31. In the preferred embodiment, orienting sleeve 31 securedly fits within muleshoe sub 16. As signal poppet 21 moves from its retracted position as shown in FIG. 2E, to the extended position shown in FIG. 1, lower end 23 of signal poppet 21 helps to restrict the flow of drilling fluid from annulus 18 through orifice 25 by narrowing the effective diameter of orifice 25. In the preferred embodiment, spring 33 is situated axially above signal poppet 21 to bias signal poppet 21 axially downward toward orifice 25. A poppet stop 35 is positioned axially above signal poppet 21 within spring 33 to limit the axially upward movement of signal poppet 21 as signal poppet 21 moves between refracted and extended positions.

A lateral passage or port 37 extends through a side portion of a lower segment of pulser body 19 such that drilling fluid flows from annulus 18 to orifice 25. In the preferred embodiment, lower end 23 of signal poppet 21 is positioned in the flow path of drilling fluid flowing from annulus 18 to orifice 25.

An inner passage 39 extends axially through signal poppet 21 from an opening formed in lower end 23 and continuing through poppet stop 35. In the preferred embodiment, a portion of inner passage 39 extending through signal poppet 21 defines inner passage 39*a* which forms the bore of signal poppet 21. Inner passage 39*a* extends axially through signal poppet 21 from an opening formed at lower end 23 to an opening formed on the axially upward end of signal poppet 21. Inner passage 39*a* is preferably in fluid communication with an axial passage 39*b* which extends through poppet stop 35. In the preferred embodiment, a seal member 41 is positioned between pulser body 19 and an upper end portion of signal poppet 21 such that drilling fluid exiting inner passage 39*a* is forced to enter inner passage 39*b*. As will be readily appreciated by those skilled in the art, seal member 41 preferably engages an outer surface of signal poppet 21 and an interior surface 43 of pulser body 19. In the preferred embodiment, inner passage 39 extends axially to a valve seat 45 positioned axially above poppet stop 35. Valve seat 45 preferably includes an opening 47 in fluid communication with inner passage 39*b*. Opening 47 extends axially through valve seat 45 and opens into a valve chamber 49. In the preferred embodiment, valve opening 47 is centrally located within valve seat 45. In the preferred embodiment, valve chamber 49 houses a lower end portion of a servo valve assembly 51.

Servo valve assembly 51 includes a servo shaft 53 extending axially upward and away from valve seat 45. Servo shaft 53 extends axially through a bore of an evacuation sub 55 that defines an upper wall of valve chamber 49. A servo cap 57 is preferably positioned on a lower end portion of servo shaft 53. Servo cap 57 is preferably formed with an outer diameter that is larger than the outer diameter of servo shaft 53. A servo tip 59 extends axially downward from servo cap 57. As will be readily understood by those skilled in the art, servo tip 59 can comprise a portion of servo cap 57. Servo shaft 53 is axially movable through evacuation sub 55 such that servo cap 57 engages an upper surface of valve seat 45 while servo tip 59 is received within opening 47 to restrict the flow of drilling fluid from inner passage 39. When servo shaft 53 is in a retracted position, servo tip 59 is removed from opening 47 such that servo cap 57 and servo tip 59 allow flow of drilling fluid from inner passage 39 into valve chamber 49.

In the preferred embodiment, a plurality of servo bellows 61 extend from an outer surface of evacuation sub 55 to an outer surface of servo shaft 53 such that drilling fluid is isolated from the interior port of evacuation sub 55 that receives servo shaft 53. In the preferred embodiment, valve chamber 49 includes an opening formed in a side of pulser body 19. A servo screen 63 is positioned across the opening formed in pulser body 19 for protecting servo valve assembly 51 from debris located outside of pulser body 19. A plurality of ports 65 extend through servo screen 63 such that drilling fluid flows through opening 47 from inner passage 39 into valve chamber 49, and out of valve chamber 49 when servo shaft 53 is in the retracted position, as shown in FIG. 2D.

In operation, when servo shaft 53 is extended axially downward to its extended position such that servo cap 57 and servo tip 59 are restricting flow of drill fluid through opening 47 from inner passage 39, an upward pressure is created against signal poppet 21 that compresses spring 33 and allows flow of drilling fluid through orifice 25 in an unrestricted manner. When servo shaft 53 is actuated axially upward such that servo cap 57 and servo tip 59 allows flow of drilling fluid through ports 65 of servo screen 63, into valve chamber 49 and out opening 47 into inner passage 39, the pressure associated with the flow of drilling fluid past lower end 23 and into inner passage 39 is relieved such that spring 33 actuates signal poppet 21 axially downward to restrict flow through orifice 25, and thereby creating a pressure pulse.

A stationary spacer 66 is positioned axially above evacuation sub 55 and receives an upper portion of servo shaft 53. In the preferred embodiment, servo shaft 53 extends axially through stationary spacer 66 to a servo socket 67 positioned at an axially opposite position from evacuation sub 55. In the preferred embodiment, servo socket 67 has a bore formed in a lower central portion of servo socket 67 for receiving servo shaft 53. Servo socket 67 is preferably attached to servo shaft 53 with threaded connectors formed on servo socket 67 and an upper end portion of servo shaft 53. As will be readily appreciated by those skilled in the art, servo socket 67 moves axially with servo shaft 53 as servo shaft 53 moves between its extended and retracted positions relative to valve seat 45 and opening 47. Servo socket 67 advantageously acts to limit the axially downward movement of servo shaft 53, servo cap 57 and servo tip 59 relative to valve seat 45 and opening 47 by engaging an upper end portion of stationary spacer 63 when servo shaft 53 moves axially downward into engagement with valve seat 45.

Servo socket 67 connected, preferably threadedly connected, to a servo mandrel 71, which contains a pin or alignment dowel 69 that prevents rotation with respect to pulser body 19. Servo mandrel 71 preferably has a mandrel bore 73 formed within an upper portion of servo mandrel 71. Mandrel bore 73 is preferably threaded and receives a converter 75 that helps to drive servo mandrel 71 axially upward and downward thereby actuating servo shaft 53 axially downward and upward relative to valve seat 45. In the embodiment shown in FIGS. 3A through 4B, converter 75 is a ball screw that is capable of translating rotational movement to axial movement that is imparted upon servo mandrel 71. However, as is readily understood by those skilled in the art, converter 75 can be several forms of mechanical devices that are capable of translating rotational movement into axial movement, such as a screw, a lead screw, a worm gear, a worm screw, or a ball screw. Converter 75 preferably extends through a plurality of radial bearings positioned above servo mandrel 71 and connects to a drive shaft 81 from a motor/gear box assembly 83 via a coupler 79.

In operation, motor/gear box assembly 83 is actuated to drive shaft 81, which then imparts rotational movement upon converter 75 via coupler 79. Converter 75 translates rotational movement from drive shaft 81 into axial movement that is imparted upon servo mandrel 71, which in turn actuates servo shaft 53 axially upward and downward relative to valve seat 45 and opening 47. In the preferred embodiment, motor/gear box assembly 83 is capable of rotating drive shaft 81 in two separate and opposite directions so that motor/gear box assembly 83 can move servo mandrel 71 and servo shaft 53 axially upward and downward as desired.

Servo mandrel 71 preferably includes a cavity 85 formed axially between the connection with converter 75 and dowel pin 69. In the preferred embodiment, a limit switch 87 is connected to pulser body 19 within cavity 85 such that mandrel 71 moves axially up and down with limit switch 87 being stationarily positioned within cavity 85. Limit switch 87 preferably includes a portion of a circuit 89 that is in electrical communication with motor/gear box assembly 83. Circuit 89 preferably actuates between open and closed positions cause motor/gear box assembly 83 to turn on and off in order to actuate servo shaft 53 axially upward and downward and thereby creating pressure pulses with pulser 13. In the preferred embodiment, circuit 89 communicates with the driver module, which in turn sends a signal responsive to limit switch 87 to turn off motor/gear box assembly 83.

Circuit 89 preferably includes switch actuators 91*a*, 91*b* that extend from limit switch 87 toward upward and downward facing shoulders 93, 95 formed on servo mandrel 71 within cavity 85. In the preferred embodiment, switch activator 91*a* extends from limit switch 87 and engages downward facing shoulder 95 when servo mandrel 71 moves from an axially upward position to an axially downward position of predetermined distance. Upon switch activator 91*a* engaging downward facing shoulder 95, the switch state of circuit 89 of limit switch 87 is changed to thereby cause the driver module to turn motor/gear box 83 off and stop driving servo shaft 53 axially downward to engage valve seat 45 and opening 47. Similarly, switch activator 91*b* engages upward facing shoulder 93 when servo mandrel 71 moves axially upward relative to valve seat 45 and opening 47. Upon engagement of switch actuator 91*b* with upward facing shoulder 93, circuit 89 of limit switch 87 closes and thereby causes the driver module to turn motor/gear box assembly 83 off and cease retracting servo shaft 53 from valve seat 45. The driver module can be an active controller that responds to the status of limit switch 87 as provided for by circuit 89, as described above. Alternatively, should a set of diodes be utilized in parallel with circuit 89, which are circumvented by the activation of actuators 91*a* and 91*b*, driver module can use passive electrical elements that inhibit the actuation of motor/gear box assembly 83 based upon an electrical output from limit switch 87.

As will be readily appreciated by those skilled in the art, switch activators 91*a*, 91*b* of limit switch 87 cause the driver module motor/gear box assembly 83 to turn off and cease the movement of mandrel 71 upon predetermined axial movements of servo mandrel 71 and servo shaft 53. The use of switch actuators 91*a*, 91*b* provides for precise control of motor/gear box assembly 83 and the distance servo mandrel 71 and servo shaft 53 travel when actuating servo valve assembly 51, thereby reducing damage to servo valve assembly 51 due to over rotation of motor/gear box assembly 83.

An inner cavity 97 is formed within upper segments of pulser body 19 for communicating power and electricity to motor gear box assembly 83. The inner cavity communicates through a centralizer mandrel 99 that is positioned within centralizer 101 which helps center pulser 11 within drill pipe 15 while moving downhole measurement tool through drill pipe 15. In the preferred embodiment, a plurality of batteries are carried within a battery housing 103 positioned axially above centralizer mandrel 99 that are in electrical communication with motor/gear box assembly 83 via inner cavity 97 extending axially therethrough. As will be readily appreciated by those skilled in the art, the driver module can be placed adjacent the batteries.

While the invention has been shown in only some of its forms, it should be apparent to those skilled in the art that it is not so limited, but is susceptible to various changes without departing from the scope of the invention.

That claimed is:

1. A downhole mud pulser for creating pressure pulses in a stream of drilling fluid circulating through a drill string, the mud pulser comprising:

a) a pulser sub defining a main flow passage in fluid communication with the drilling fluid, the main flow passage having a longitudinal axis;

b) an orifice in the main flow passage;

c) a pulser body installed within the main flow passage and containing a signal poppet having an annular piston reciprocally carried within the pulser body, the signal poppet having a lower end that restricts flow of the drilling fluid and creates a pressure pulse while in an extended position within the orifice and allows unrestricted flow of the drilling fluid while in a retracted position removed from the orifice;

d) an inner passage in the pulser body extending through the piston and the signal poppet for the passage of drilling fluid from the main flow passage, the inner passage having an upward facing servo seat formed therein;

e) an axially movable servo valve that selectively engages the servo seat to control flow of drilling fluid through the inner passage to the piston, the servo valve being a part of a servo valve assembly that moves in unison, the servo valve assembly having an upward-facing contact surface and a downward-facing contact surface that are axially spaced apart from each other;

f) a motor carried within the pulser body having a drive shaft that is operatively engaged with the servo valve assembly and causes axial movement of the servo valve assembly to drive the servo valve into engagement with the servo seat when the motor rotates the drive shaft in a first direction and out of engagement with the servo seat when the motor rotates the drive shaft in a second direction; and g) a limit switch in electrical communication with the motor, the limit switch having an actuator device that contacts the downward-facing contact surface of the servo valve assembly when the servo valve assembly reaches an extended position, initiating the motor stop rotating the drive shaft in the first direction, and the actuator device contacting the upward-facing contact surface of the servo valve assembly when the servo valve assembly reaches a retracted position, initiating the motor to stop rotation of the drive shaft in the second direction;

h) wherein the servo valve assembly comprises a servo valve, a servo valve shaft having a lower end attached to the servo valve, and a servo valve mandrel attached to an upper end of the servo valve shaft, and wherein the pulser further comprises a spacer stationarily mounted in the body between the servo valve and the servo valve mandrel, the spacer having an upward facing surface and a spacer passage extending axially through the spacer, the servo valve shaft being within the spacer passage and axially movable relative to the space; and wherein the servo valve mandrel has a downward facing shoulder that abuts the upward facing surface of the spacer, limiting further extension of the servo valve assembly, and lifts above the upward facing surface of the spacer when the servo valve assembly moves toward the retracted position.

2. The downhole mud pulser of claim 1, wherein the servo valve assembly has a laterally protruding protuberance, with the upward-facing contact surface being on an upper end of the protuberance and the downward-facing contact surface being on an upper end of the protuberance and the downward-facing surface being on a lower end of the protuberance.

3. The downhole mud pulser of claim 1, wherein the actuator device comprises:

a first arm that contacts the downward-facing contact surface when the servo valve assembly reaches the extended position;

a second arm that contacts the upward-facing contact surface when the servo valve assembly reaches the retracted position; and wherein the arms are positioned side-by-side.

4. The downhole mud pulser of claim 1, wherein the servo valve assembly has a cavity on one side with a cylindrical portion above and below the cavity, a laterally protruding protuberance located within the cavity, with the upward-facing contact surface being on an upper end of the protuberance and the downward-facing contact surface being on a lower end of the protuberance.

5. The downhole mud pulser of claim 1, further comprising: a spacer stationarily mounted in the body between the servo valve and the drive shaft; wherein the servo valve assembly comprises:

a servo valve shaft extending upward from the servo valve through an axial passage in the spacer;

a servo valve mandrel extending upward from the servo valve shaft above the spacer, the servo valve mandrel having a larger cross-sectional dimension than the passage in the spacer; and wherein the servo valve mandrel is operatively engaged with the drive shaft of the motor and contains the upward-facing and downward-facing contact surfaces.

6. The downhole mud pulser of claim 1, wherein the motor converter comprises a mechanical device selected from a group consisting of a screw, a lead screw, a worm screw, a worm gear, a worm screw, and a ball screw.

7. A downhole mud pulser for creating pressure pulses in a stream of drilling fluid circulating through a drill string, the mud pulser comprising:

a) a pulser sub defining a main flow passage for the passage of the drilling fluid;

b) an orifice positioned within the pulser sub which receives the drilling fluid from the main flow passage;

c) a pulser body located in the main flow passage and containing a downwardly biased signal poppet having an annular piston reciprocally carried within the body, the signal poppet having a lower end that selectively restricts flow through the orifice, the lower end restricting flow of the drilling fluid and creating a pressure pulse while in an extended position within the orifice and allowing unrestricted flow of the flow of the drilling fluid while in a retracted position removed from the orifice, the piston and signal poppet having an inner passage extending axially therethrough to communicate drilling fluid from the main flow passage, the inner passage having an upward facing servo seat formed therein;

d) a port in the body leading from the main flow passage to a point below and in communication with the piston for supplying pressure from the drilling fluid to move the piston;

e) an axially movable servo valve that selectively engages the servo seat to control flow of drilling fluid through the inner passage to the piston, the servo valve being operatively engaged and movable in unison with a valve mandrel positioned above the servo valve;

f) a motor carried within the pulser body and having a drive shaft in engagement with a threaded receptacle in an upper portion of the valve mandrel such that rotation of the drive shaft in a first direction causes the valve mandrel to axially extend to place the servo valve into engagement with the servo seat, and rotation of the drive shaft in a second direction causes the valve mandrel to axially retract to disengage the servo valve from engagement with the servo seat, the valve mandrel having a laterally extending protuberance with an upper contact surface facing upward and a lower contact surface below the upper contact surface and facing downward; and g) a limit switch in electrical communication with the motor and located alongside the valve mandrel, the limit switch having a first arm that is engaged by the lower contact surface of the valve mandrel when the valve mandrel reaches an extended position, causing the motor to stop rotating the drive shaft in the first direction, and the limit switch having a second arm that is engaged by the upper contact surface of the valve mandrel when the valve mandrel reaches a retracted position, causing the motor to stop rotating the drive shaft in the second direction;

h) a spacer stationarily mounted in the body between the servo valve and the valve mandrel, the spacer having an upward facing surface and a spacer passage extending axially through the spacer; and a servo valve shaft within the spacer passage and axially movable relative to the spacer, the servo valve shaft having an upper end extending above the spacer and joined to the valve mandrel for movement therewith, the servo valve being secured to a lower end of the servo valve shaft for movement therewith; and wherein the valve mandrel has a downward facing shoulder that abuts the upward facing surface of the spacer, defining a limit for extended movement of the valve mandrel, and lifts above the upward facing surface of the spacer when the valve mandrel moves toward the retracted position.

8. The downhole mud pulser of claim 7, wherein the upper contact surface of the valve mandrel comprises an upward facing shoulder, and the lower contact surface of the valve mandrel comprises a downward facing shoulder.

9. The downhole mud pulser of claim 7 wherein:

the valve mandrel has a cavity on one side with a cylindrical portion above and below the cavity;

a laterally protruding protuberance located within the cavity, with the upper contact surface being on an upper end of the protuberance and the downward facing contact surface being on a lower end of the protuberance; and the arms of the limit switch protrude into the cavity.

10. The downhole mud pulser of claim 7 wherein the first and second arms of the limit switch are side-by-side and parallel with each other.

11. The downhole mud pulser of claim 7 further comprising a motor converter that translates rotational movement of the drive shaft of the motor to axial movement of the servo valve mandrel, the motor converter comprising a mechanical device selected from a group consisting of a screw, lead screw, a worm screw, a worm gear, a worm screw, and a ball screw.

12. A downhole mud pulser for creating pressure pulses in a stream of drilling fluid circulating through a drill string, comprising:

a body having a longitudinal axis;

a servo valve seat in the body;

a servo valve element movable into and out of engagement with the seat;

a spacer stationarily mounted in the body above the servo valve element and having an axially extending spacer passage;

a servo valve shaft having a lower end secured to the servo valve element for movement therewith, the servo valve shaft extending through the spacer passage and axially movable relative to the spacer, the servo valve shaft having an upper end extending above the spacer;

a servo valve mandrel secured to the upper end of the servo valve shaft for movement therewith, the servo valve mandrel having an upper end containing a threaded receptacle, the servo valve mandrel having a cavity on one side with a cylindrical portion above and a cylindrical portion below the cavity;

a laterally extending protuberance within the cavity with an upper contact surface facing upward and a lower contact surface below the upper contact surface and facing downward, the contact surfaces being recessed within the cavity;

a motor carried within the pulser body and having a drive shaft in engagement with the threaded receptacle such that rotation of the drive shaft in a first direction causes the servo valve mandrel to axially extend to place the servo valve into engagement with the servo seat, and rotation of the drive shaft in a second direction causes the valve mandrel to axially retract to disengage the servo valve from engagement with the servo seat;

a limit switch in electrical communication with the motor and located alongside the valve mandrel, the limit switch having a first arm that protrudes into the cavity and is engaged by the lower contact surface of the servo valve mandrel when the servo valve mandrel reaches an extended position, causing the motor to stop rotating the drive shaft in the first direction, and the limit switch having a second arm that protrudes into the cavity and is engaged by the upper contact surface of the servo valve mandrel when the servo valve mandrel reaches a retracted position, causing the motor to stop rotating the drive shaft in the second direction; and wherein the valve mandrel has a downward facing shoulder that abuts an upward facing surface of the spacer to provide a stop for extending movement of the valve mandrel, and lifts above the upward facing surface of the spacer when the valve mandrel moves toward the retracted position.

* * * * *